United States Patent [19]

Castro

[11] 4,390,294

[45] Jun. 28, 1983

[54] RIBBON RE-INKING MACHINE CAPABLE OF RELOADING A VARIETY OF TYPES OF RIBBON CASSETTES

[75] Inventor: Albert J. Castro, San Gabriel, Calif.

[73] Assignee: Westates Space-Era Products, Inc. dba Wespac, South El Monte, Calif.

[21] Appl. No.: 183,204

[22] Filed: Sep. 2, 1980

[51] Int. Cl.[3] ..... B41J 33/10

[52] U.S. Cl. ..... 400/196.1; 400/198; 400/202.4; 118/60; 118/235; 427/141

[58] Field of Search ..... 400/194, 195, 196, 196.1, 400/197, 198, 200, 201, 202, 202.2, 202.3, 202.4, 208, 207; 118/235, 60; 427/141

[56] References Cited

U.S. PATENT DOCUMENTS

| | | | |
|---|---|---|---|
| 2,005,503 | 6/1935 | Pelton | 400/201 |
| 3,603,283 | 9/1971 | Anderson et al. | 118/235 X |
| 3,887,056 | 6/1975 | Lehmann | 400/196 |
| 3,977,512 | 8/1976 | Teagarden et al. | 400/195 |
| 3,981,387 | 9/1976 | Gottschlich | 400/195 X |
| 4,011,830 | 3/1977 | Anderson et al. | 118/60 |
| 4,050,617 | 9/1977 | Biggs et al. | 400/196.1 X |
| 4,126,715 | 11/1978 | Schiffmacher et al. | 400/196.1 X |
| 4,128,348 | 12/1978 | Steele et al. | 400/200 X |

*Primary Examiner*—Ernest T. Wright, Jr.

*Attorney, Agent, or Firm*—K. H. Boswell; Edward D. O'Brian

[57] ABSTRACT

A ribbon machine which is capable of feeding ribbon to the inlet or feed opening of a ribbon cassette is improved by providing the ribbon machine with a support surface having a ribbon pathway thereon and at least two cassette adapters, each one of which can be positioned at one of a plurality of adapter positions on the support surface. The cassette adapters each are capable of holding at least one type of a variety of types of ribbon cassettes. Each of the adapter positions on the support surface includes a member capable of driving either an internal or external sprocket wheel or other drive wheel which feeds the ribbon into the cassette and a cassette adapter holding member which holds the cassette adapter at a particular adapter position. Each of the cassette adapters is constructed to include the capability of allowing the drive member at each of the adapter positions to interact with the cassette to feed the ribbon into the cassette.

16 Claims, 11 Drawing Figures

RIBBON RE-INKING MACHINE CAPABLE OF RELOADING A VARIETY OF TYPES OF RIBBON CASSETTES

BACKGROUND OF THE INVENTION

This invention is directed to a ribbon machine capable of feeding a ribbon into a ribbon cassette wherein the cassette is any one of a variety of types of styles of different cassettes manufactured by different manufacturers and differing structurally from one another. The ribbon can be fed either from the cassette around a re-inking apparatus and back to the cassette or a replacement ribbon can be fed into the cassette.

A variety of machines use ribbon cassettes to supply a continuous inked ribbon to a printing head. Such machines include printers for calculaters, computers and other related machines wherein a graphic or written printout is desirable. The ribbons utilized with these machines can either be a continuous loop or a continuous mobius loop. In any event, the ribbon loop is stored in a cassette and a small section of this loop is located outside of the cassette between a discharge opening and a feed opening on the cassette. In use, the ribbon circulates out of the cassette past the appropriate printing head or the like and is re-inserted into the cassette.

The ribbons used in the above noted cassettes are generally of a fabric material which retains a quantity of printing ink in them. After one or more passes past a printing head the quantity of ink in the ribbon can be depleted to the point wherein the legibility of the printed matter deteriorates. Instead of destroying the cassette and its ribbon, re-inking machines have been developed to re-ink the ribbon.

Unfortunately, manufacturers of different machines which utilize the cassette type ribbons discussed above have made no attempt to standardize either the ribbons or the cassettes. The majority of the cassettes currently found in the marketplace incorporate an internal rewind sprocket or knurled wheel. However, one major manufacturer utilizes a cassette which requires a rewind wheel which is located outside of the cassette. There are cassettes wherein the rewind wheels are located on the right hand side of the cassette and those where they are located on the left hand side, and further some of the rewind wheels are driven clockwise while some are driven counterclockwise.

Certain re-inking machines have been described such as that in U.S. Pat. No. 4,126,715. Unfortunately re-inking machines such as those described in this patent are directed to utilization of only one type of cassette or cartridge. A cassette differing from the exact cassette which the above noted re-inking machine is set up for cannot be re-inked on this machine. For any user who has two ribbon using machines which utilize different types of cassettes the above noted machine is only useful to re-ink one type of cassette.

BRIEF SUMMARY OF THE INVENTION

In view of the above discussion it is an object of this invention to provide a ribbon machine which is capable of feeding a ribbon into a ribbon cassette regardless of the outside configuration of the cassette or the manner in which the ribbon is fed into it. It is a further object to provide a machine which not only can re-ink the ribbon of a variety of different types of cassettes, but which is also capable of feeding a new ribbon into an old empty cassette. In view of the above two objects it is a generalized object to provide a machine which allows the user to re-use cassettes regardless of the state of the ribbon in the cassette.

These and other objects are achieved in an improvement in a ribbon machine of the type capable of feeding a ribbon into a ribbon cassette, the cassette being of the type having a ribbon discharge opening and a ribbon feed opening, which comprises: a support surface; ribbon guide means associated with said support surface for guiding said ribbon over said support surface from the ribbon discharge opening to the ribbon feed opening of said cassette; at least two cassette adapters, each adapter including cassette holding means capable of reversibly holding on said adapter at least one type of a variety of types of cassettes and each of said cassette holders capable of holding a different type of cassette; a plurality of adapter positions located on said support surface, each of said adapter positions including cassette drive means and cassette adapter holding means, each of said cassette adapters capable of being held by said cassette adapter holding means at each of said plurality of adapter positions; each of said cassette adapters including cassette drive means transfer means capable of allowing said cassette drive means to interact with said cassette to feed said ribbon into said cassette.

Preferably the cassette adapters include an adapter plate having a top face and a bottom face. The bottom face includes an adapter plate orientation and retaining means. The adapter plate orientation and retaining means interacts with the cassette adapter holding means at each of the adapter positions to correctly orient and reversibly retain the adapter plate at that particular adapter position to enable the cassette drive means to be coupled with the cassette for re-feeding the ribbon back into the cassette. At each of the adapter positions, therefore, the cassette drive means preferably includes a drive shaft, a portion of which projects above the support surface.

Each of the cassette adapter holding means preferably includes both a plate locking fixture and a plate aligning fixture and these in turn interact with a surface locking fixture and surface aligning fixture located at each of the adapter positions.

An external ribbon feed reservoir means can also be utilized with the ribbon machine. This allows a new ribbon to be fed into an old cassette case. The reservoir means includes a ribbon reservoir capable of holding a continuous loop of a ribbon and a ribbon separating means which is capable of separating the two halves of the loop of ribbon which tend to stick to one another when the ribbon is wound as a continuous spiral.

BRIEF DESCRIPTION OF THE DRAWING

This invention will be better understood when taken in conjunction with the drawing in which.

Those skilled in the art to which this invention pertains upon reading this specification will be apprised of certain principles and/or concepts which are set forth in the claims appended to this specification. It will be realized, of course, that these principles and/or concepts are capable of being expressed and utilized in embodiments differing from the exact descriptive embodiments herein described. In view of this, this invention is to be construed in light of the claims and is not to be construed as being limited to only that embodiment utilized in the specification for illustrative purposes.

DETAILED DESCRIPTION

Figure 1:
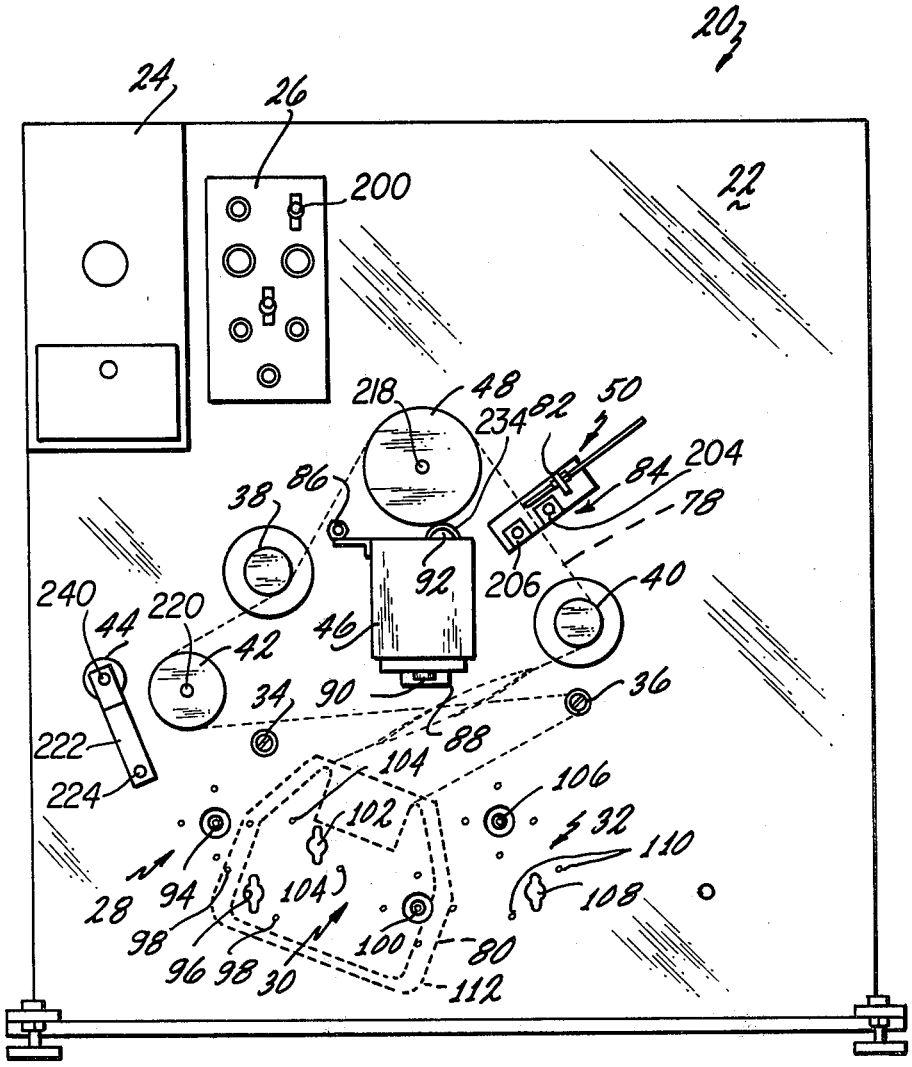
FIG. 1 is a front elevational view of a ribbon re-inking machine utilizing the invention and showing a typical cassette and its ribbon pathway as used in practicing the invention.
Figure 2:
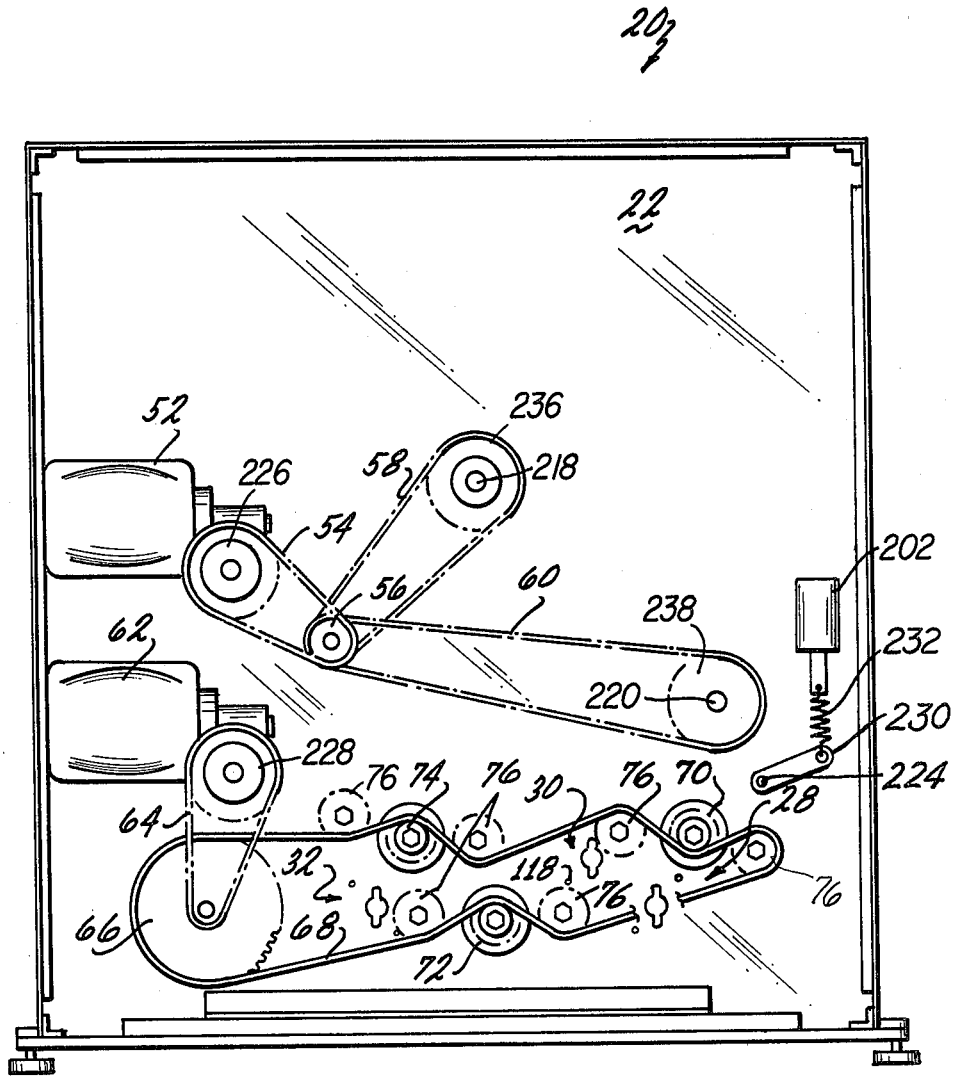
FIG. 2 is a rear elevational view showing the reverse side of the machine of FIG. 1.

FIGS. 1 and 2 show the front side and back side of a ribbon machine 20 which utilizes this invention. The machine 20 is adapted to stand upright and incorporates a vertically oriented support surface 22. Mounted to and around this support surface 22 are various other cover panels, supporting feet and the like which, in the interest of brevity, will not be discussed since they do not form a part of this invention.

On the front side of the support surface 22 is cassette speed control 24 and main control 26. Near the lowermost portion of surface 22 are three adapter positions generally located by numerals 28, 30 and 32. Above the adapter positions 28, 30 and 32 are guide spools 34 and 36, heater spindles 38 and 40, capstan 42 and its associated pinch wheel 44. Capstan 42 is located on pivot shaft 220. Pinch wheel 44 is mounted to arm 222 via pin 240. Arm 222 in turn is fixedly mounted on shaft 224. Located between the heater spindles 38 and 40 is ink reservoir 46. Directly above the ink reservoir 46 is inking drum 48 mounted on pivot shaft 218. Inbetween the inking drum 48 and the heating spindle 40 is ribbon sensing unit 50.

Referring to the back side of the machine 20 there is a first drive motor 52 which drives a sprocket wheel 226 which is operatively connected via drive chain 54 to a sprocket wheel 56. Chain 58 connects sprocket wheel 56 to sprocket wheel 236 which is mounted on pivot shaft 218 on the back side of inking drum 48 and chain 60 connects sprocket wheel 56 to sprocket wheel 238 mounted on pivot shaft 220 on the back side of capstan 42.

A second motor 62, which is a variable speed motor, drives sprocket wheel 228 which is operatively connected via chain 64 to sprocket wheel 66. A chain 68 passes around sprocket wheel 66 and drive shaft sprockets 70, 72 and 74, as well as several idler wheels collectively identified by the numeral 76 which appropriately position the chain 68 around the drive shaft sprockets 70, 72 and 74.

Preferably there are about eight major styles of commercially available ribbon cassettes in common use. Except as otherwise noted in FIGS. 10 and 11, the numeral 80 will be utilized to interchangeably refer to these cassettes.

In a typical operation such as re-inking of a ribbon 78 located in a cassette 80 as illustrated in FIG. 1, the loop of the ribbon 78 which is external of the cassette 80 is looped around first heater spindle 40, then passed through ribbon sensing unit 50, across the surface of inking drum 48, underneath heater spindle 38, around capstan 42 and finally around guide spool 36 prior to returning to the cassette 80. The cassette 80 is mounted on support surface 22 as hereinafter disclosed. On energizing switch 200 in main control 26, a solenoid 202 stretches spring 232 which in turn rotates arm 230 and shaft 224 to which it is fixedly mounted. This causes pinch wheel 44 to move against the surface of the capstan 42 pinching the ribbon 78 against the surface of the capstan 42. The motor 52 causes both the capstan 42 and the inking drum 48 to rotate via the appropriate chains 54, 58 and 60. The heater spindles 38 and 40 can be appropriately activated to heat and iron the ribbon 78. The ribbon 78 is driven around the inking drum 48 and the capstan 42 toward the guide spool 36. The cassette speed control 24 is turned on and the speed of variable drive motor 62 adjusted such that the ribbon 78 is taken back up into the cassette 80 at the same speed it comes off of capstan 42. In this way the ribbon 78 is continuously fed around the ribbon pathway across the support surface 22. The use of the guide spools 34 and 36 depend on the particular type of cassette which is being utilized as well as its placement at one of the particular adapter positions 28, 30 or 32.

The ribbon sensing unit 50 is a dual functioning unit. It has a spot sensing device 82 and a photocell or equivalent device 84. Prior to starting movement of the ribbon 78, after loading is completed, a small white dot using liquid paper or other conveniently available material is placed on the ribbon 78. After the ribbon 78 has completed a circuit completely around all of the above noted components and into and out of the cassette 80 the dot is sensed by the spot sensing device 82 and the ribbon machine 20 is automatically shut off. Should the ribbon 78 break or should it have a hole or other discontinuity which would impede its function and/or performance, the photocell device 84 will sense such a break or hole as the ribbon 78 is run between the sending unit 204 and receiving unit 206.

The ink reservoir 46 is pivotally suspended about axle 86. A bracket 88 projects out from support surface 22. A control knob 90 passes through the bracket 88 and against the underside of the reservoir 46. By turning the control knob 90 the reservoir 46 is pivoted about axle 86 such that ink supply roller 92 goes toward and away from the inking drum 48. The ink supply roller 92 has a soft surface 234 which picks up the ink from the reservoir 46 and deposits it onto the surface of the inking drum 48. The roller 92 can be made to put a varying amount of pressure created between it and the inking drum 48 as determined by the position of the control knob 90.

Heater spindles 38 and 40 are placed on both sides of inking drum 48. Such an arrangement has a two-fold advantage. Heater spindle 38 is utilized in drying the ink placed in the ribbon 78 as is commonly practiced in existing machines. Heating spindle 40 by being placed in front of the inking drum 48 (with regard to the direction of movement of the ribbon 78) irons and smooths the ribbon 78 prior to passage over the surface of the inking drum 48. This ensures a more even distribution of ink into the ribbon 78. Inside of the cassettes 80 the ribbons 78 are crinkled or accordion-folded. When they exit the cassettes 80 this crinkling or folding can interfere with successful re-inking operation. Heater spindle 40 serves to assure a more uniform distribution of ink into the ribbon 78. Both the heater spindles 38 and 40 are hollow metal shells which have a small wattage lightbulb placed therein to serve as a heat source.

Each of the adapter positions 28, 30 and 32 have similar components. At position 28 there is a drive shaft 94, locking hole 96, and aligning holes collectively identified by the numeral 98. At position 30 there is a drive shaft 100, a locking hole 102, and aligning holes collectively identified by the numeral 104. At position 32 there is a drive shaft 106, a locking hole 108 and aligning holes collectively identified by the numeral 110. The spatial relationship between these individual components located at the different positions 28, 30 and 32 is slightly different.

For positions 28 and 32 the drive shafts 94 and 106 are to the left of locking holes 96 and 108 respectively and in position 30 the drive shaft 100 is to the right of locking hole 102. For positions 28 and 30 the aligning holes 98 and 104 respectively lie in a Southeast, Northwest orientation with respect to the locking holes 96 and 102 while for position 32 the aligning holes 110 lie in a Southwest, Northeast orientation with respect to locking hole 108. Aligning holes 98 are spaced differently with respect to the distance between one another than are aligning holes 104. It can thus be seen that each individual set of drive shafts 94, 100 and 106 respectively, locking holes 96, 102 and 108 respectively, and aligning holes 98, 104 and 110 respectively, are different for each of the positions 28, 30 and 32.

As viewed in FIG. 2, sprocket wheel 66 turns counterclockwise. Because of the threading arrangement of the chain 68 about drive shaft sprockets 70, 72 and 74 drive shafts 94 and 100 rotate in one direction and drive shaft 106 rotates in the opposite direction. With the orientation of the components located at each of the positions 28, 30 and 32 as well as the direction of rotation of the drive shafts 94, 100 and 106 all existing commercial cassettes can be utilized on the ribbon machine 20.

Figure 4:
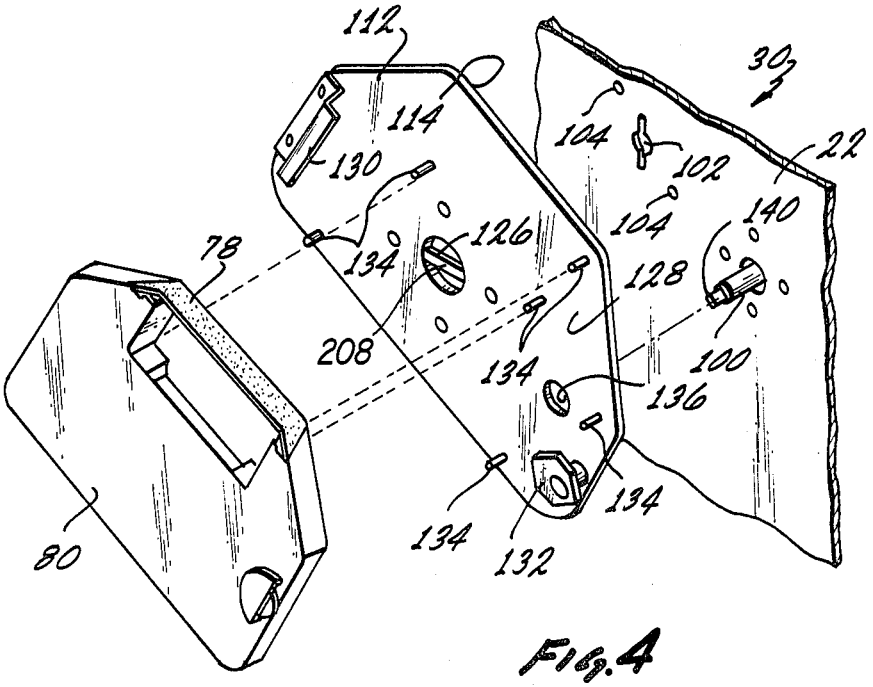
FIG. 4 is an exploded isometric view of a typical cassette, adapter plate, and the central bottom portion of the machine shown in FIG. 1.
Figure 5:
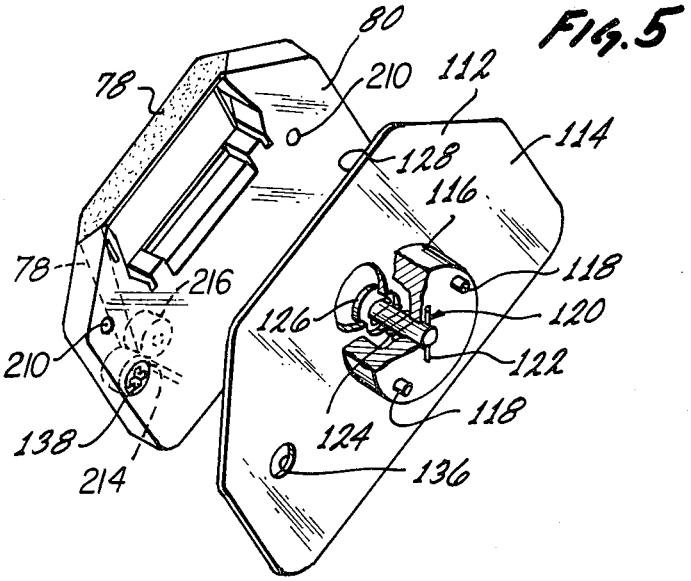
FIG. 5 is an isometric view of the reverse sides of the cassette and adapter plate shown in FIG. 4.

In FIGS. 4 and 5 there is shown an adapter plate 112 which is designed to fit onto adapter position 30. This adapter plate 112 as well as other adapter plates 142, 144 and 148, hereinafter discussed, which are capable of fitting onto position 30 or one of the other positions 28 or 32, are attached to a support surface 22 by similar mechanisms. On the bottom face 114 of the adapter plate 112 a semi-hollow disk 116 projects downwardly. Two aligning pins collectively identified by the numeral 118 are positioned such that they are capable of fitting into aligning holes 104. A locking key 120 projects from the center of the disk 116. The locking key 120 has a small traverse shaft 122 which fits into the key-hole shape of the locking hole 102. When the locking key 120, after being placed into the locking hole 102, is turned approximately 45 degrees the shaft 122 is positioned such that it can no longer pull free of the locking hole 102. A small compression spring 124 is located in the interior of the disk 116. It biases the shaft 122 against the inside surface of the support surface 22 when the locking key 120 is appropriately twisted in the locking hole 102. The head 126 of shaft 122 is appropriately equipped with a tang 208 allowing convenient twisting of the head 126 by the fingers of the operator of the machine 20.

The majority of the adapter plate i.e., plates 142, 144 and 148 utilized in this invention are similar to adapter plate 112. On one side of the top face 128 of plate 112 is a locking bar 130 and on the opposite side is an eccentrically mounted, rotatable locking knob 132. Projecting upwardly from the top face 128 of plate 112 are cassette positioning pins collectively identified by the numeral 134 which fit into appropriate holes 210 formed in the bottom of the cassette 80 during manufacture. In mounting the cassette 80 on the plate 112 one edge of the cassette is slipped underneath the locking bar 130 and the cassette 80 then is located over the aligning pin 134. The locking knob 132 is then rotated fitting over the edge of the cassette 80 fixedly attaching it to the adapter plate 112.

A hole 136 in the adapter plate 112 serves as a means for allowing drive shaft 100 to traverse through plate 112 and interact with a set of pinch wheels 214 and 216 located within the interior of the commercially available cassette 80. Operatively formed on pinch wheel 214 and exposed outside of cassette 80 is a star socket 138 which receives the flattened end 140 of the drive shaft 100. The other drive shafts 94 and 106 are also appropriately shaped and interact with star sockets 138 in other cassettes 80.

Figure 6:
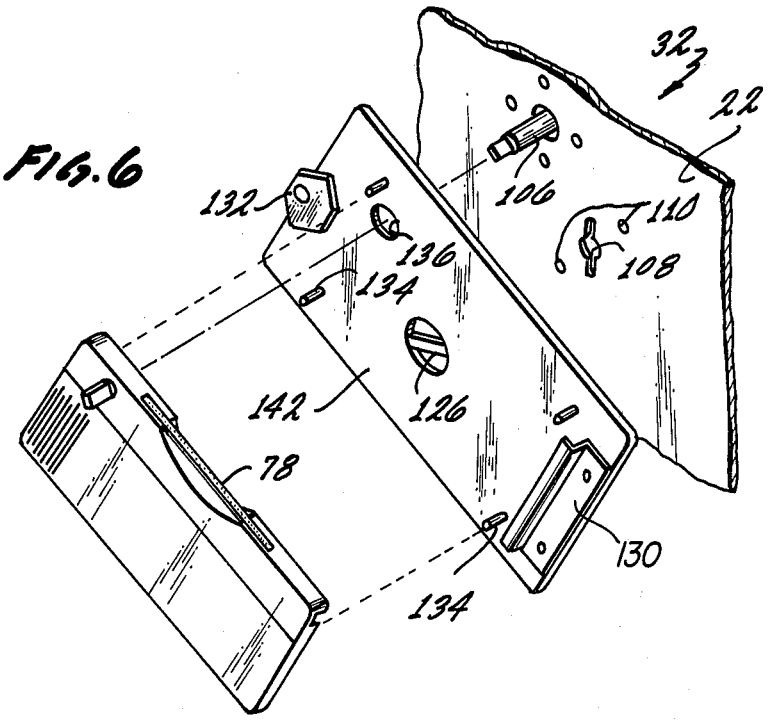
FIGS. 6 and 7 are figures similar to those of 4 and 5 except the portion of the ribbon machine shown is found on the lower right hand side of FIG. 1.
Figure 7:
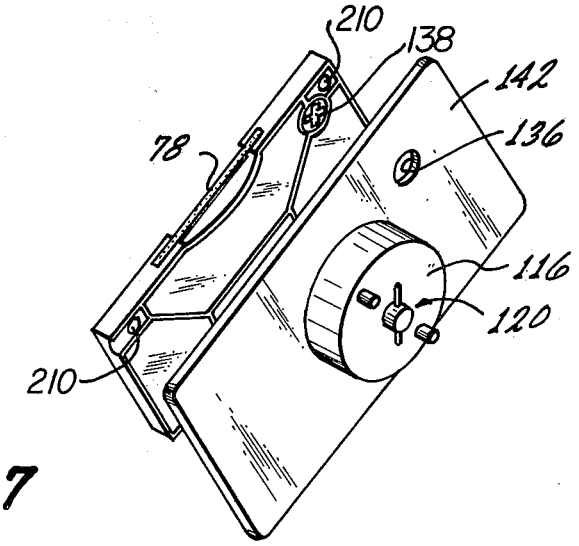

In FIGS. 6 and 7 a different adapter plate 142 is shown which fits onto position 32 of the support surface 22. Drive shaft 106, locking hole 108 and aligning holes 110 are shown which are appropriately placed to allow the adapter plate 142 to be mounted to the support surface 22 in the same manner as was adapter plate 112.

Figure 8:
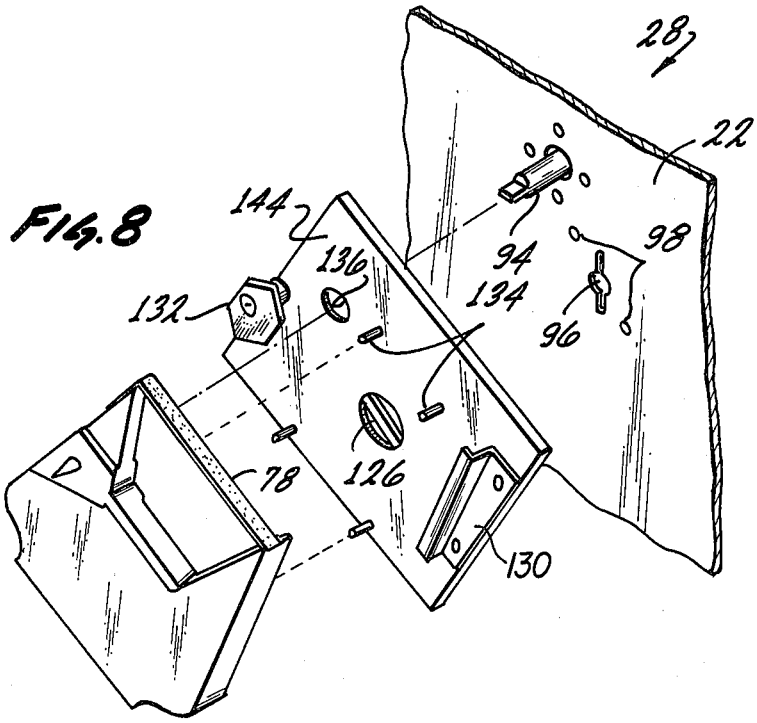
FIGS. 8 and 9 are figures similar to those of 4 and 5 except the portion of the ribbon machine shown is found on the left hand side of FIG. 1.
Figure 9:
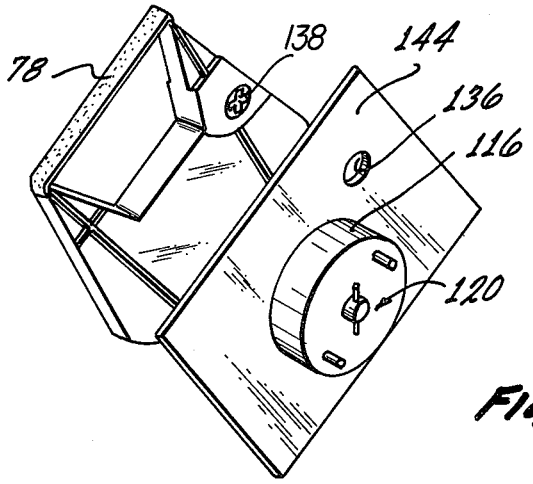

In FIGS. 8 and 9 a third adapter plate 144 is shown which appropriately mounts at adapter position 28. As noted above there is presently about eight major styles of commercially available cassettes which are utilized. All of these either have a counterclockwise rotating rewind pinch wheel 214 located on the left hand side of the cassette, a counterclockwise rotating rewind pinch wheel 214 located on the right hand side of the cassette, or a clockwise rotating rewind pinch wheel 214 located on the left hand side of the cassette. Through the use of appropriate adapter plates, including adapter plates 112, 142 and 144, as well as several others of similar construction all of these different cassettes can be rewound at one or the other of the positions 28, 30 or 32.

Figure 11:
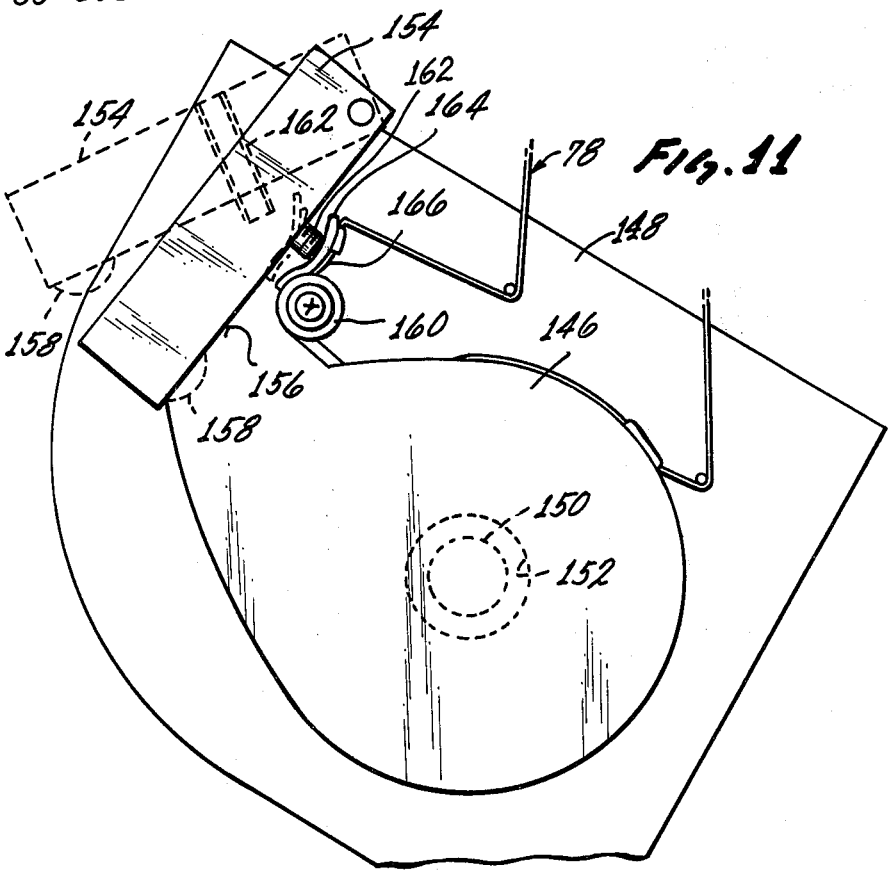
FIG. 11 is a top plan view of a cassette and adapter plate showing utilization of a type of cassette differing from that shown in FIGS. 4 through 9.

In FIG. 11 there is illustrated a cassette 146 sometimes referred to as a "pork chop" cassette because of its shape. This cassette 146 differs from the other type of cassette 80 in that it does not have a set of internal rewind pinch wheels 214 and 216. The adapter plate 148 utilized for this cassette 146 differs somewhat from the other adapter plates, plates 112, 142, and 144, previously described. A boss 150 extends upwardly from the top surface of the adapter plate 148. This boss 150 fits into a hole 152 formed in cassette 146. A swing arm 154 swings over end 156 of cassette 146 such that a small lip 158 on the swing arm 154 fits under end 156, retaining the cassette 146 in an appropriate position on adapter plate 148. A knurled knob 160 is rotatably mounted on adapter plate 148. The underside of this knob or wheel 160 (not seen in FIG. 11) contains an appropriate star socket like socket 138 which can interact with drive shaft 106 to turn wheel 160. An adjustable screw 162 running through swing arm 154 pushes against flexible member 164 formed as a part of the cassette 146. This squeezes ribbon portion 166 against the surface of wheel 160 allowing wheel 160 to appropriately feed ribbon portion 166 into the cassette 146.

Figure 3:
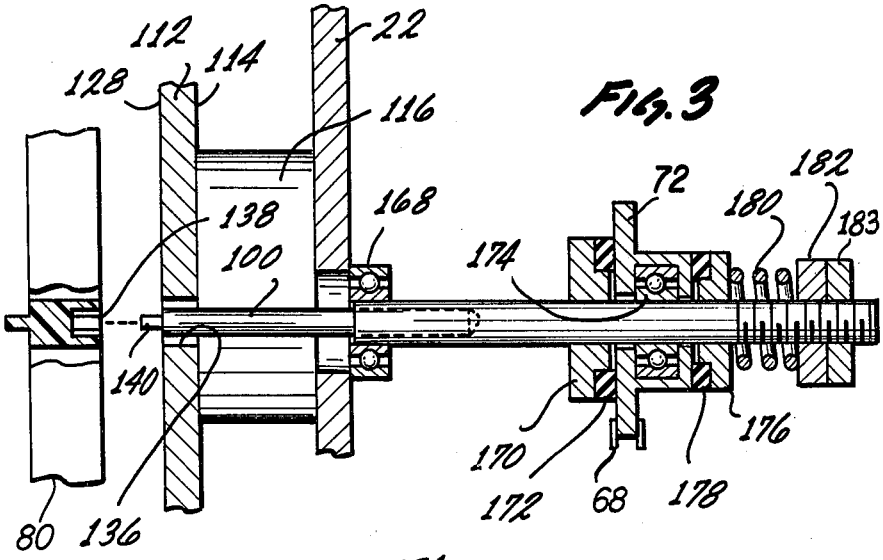
FIG. 3 is a side elevational view in section of one of the cassette drive mechanisms found in the lower part of FIGS. 1 and 2.

In FIG. 3 one of the drive shafts 100 is shown in cut-away to illustrate how it is mounted on support surface 22 and how it interacts with the adapter plate 112 and cassette 80. For illustrative purposes adapter plate 112 is utilized. Thus, the numbers corresponding to position 30 are shown in FIG. 3, but it could also represent the other positions i.e., positions 28 and 32. Drive shaft 100 is appropriately mounted to the underside of support surface 22 via bearing race 168. A clutch action isolates drive shaft 100 from drive chain 68. An annular support member 170 is fixedly attached to drive shaft 100. It carries on it a fiber washer 172 which abuts against the surface of drive shaft sprocket 72. Drive shaft sprocket 72 is freely mounted about shaft 100 by bearing race 174. Ring 176 having a fiber washer 178 is slidably keyed in a conventional manner on shaft 100. A compression spring 180, however, pushes between ring 176 and nuts 182 and 183 threaded on the end of shaft 100. This biases ring 176 and its fiber washer 178 against drive shaft sprocket 72 which in turn biases the other side of the drive shaft sprocket 72 against fiber wahser 172. Via the friction between the sprocket 72 and the washers 172 and 178, rotary motion of the sprocket 72 is transferred to the shaft 100. Should the shaft 100 be locked for any reason such as binding of the ribbon 78 or the cassette 80 the fiber washers 172 and 178 will slip against the surface of sprocket 72 preventing transferral of the rotary motion of sprocket 72 to the shaft 100. Further, if the drive sprocket wheel 66 is caused to rotate at too great a speed by inappropriate adjustment of cassette speed control 24 in regard to speed of the ribbon 78 around capstan 42, the sprocket 72 will also spin within the fiber washers 172 and 178.

Figure 10:
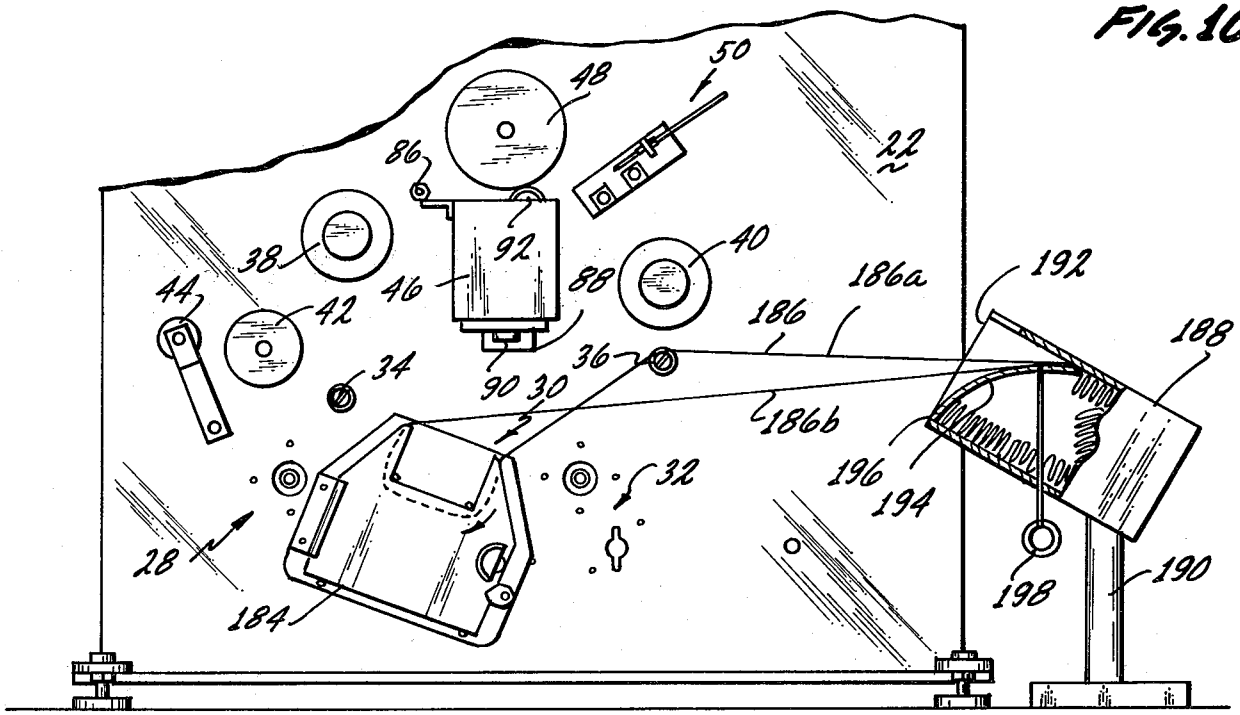
FIG. 10 is a front elevational view of portions of the machine shown in FIG. 1 with the addition of a ribbon reservoir shown on the right hand side of the machine.

In FIG. 10 the invention is shown wherein a cassette 184 has been relieved of its old ribbon and a new ribbon 186 is being wound in it by opening the cassette 184, taking the old ribbon out and inserting a loop of a new ribbon 186 into it. The new ribbon 186 comes in what is called a "pancake" package. It is a continuous loop or a loop having a turn in it (a mobius loop) which has been spirally wound much like a spiral spring. A reservoir 188 is appropriately mounted on a stand 190 next to surface 22. The reservoir 188 has an opening 192 in one end. Inside this opening is a leaf spring 194 which is fixedly attached to one side of the opening 196 and bends inward into the interior of the reservoir 188. The pancake is inserted in through the end 192 past the spring 194 until all but one end of its loop is located within the reservoir 188. This one end would be the very end of the spiral winding.

Depending on exactly what cassette it is being wound into, the cassette 184 is appropriately located at one of the positions 28, 30 or 32 and the loop of the ribbon 186 is wound about one or more of the guide spools 34 or 36 as will be necessary depending on the geometry of the cassette with respect to the support surface 22.

The pancake of the new ribbon 186 has a fresh ink supply and because of the spiral winding the two sides of the loop—i.e., side **186*a* and 186*b*—tend to stick to one another. In winding into the cassette 184 only one of these sides—side 186*a*—need be withdrawn from the reservoir 188. The other side (side 186*b*) should be held stationary since we do not want to rewind the cassette 184 or have a mess of loose ribbon 186 between the cassette 184 and the reservoir 188. Because the two sides 186*a* and 186*b* tend to stick together they must be separated prior to removal from the reservoir 188. The spring 194 tends to unstick them as the side 186*a* is withdrawn from reservoir 188. The spring 194 jams both sides 186*a*, 186of the ribbon 186 against the side of the reservior 188. The side closest to it—side 186*b*—is retained on the end of the spring 194 within the interior of the reservoir 188. The other side—side 186*a*—is separated from side 186*b* and is pulled from the reservoir 188 to be wound into the cassette 184. The spring 194 thus serves to separate the two sides or segments 186*a* and 186*b* of the loop of ribbon 186 allowing only one side 186*a* to be pulled from the reservoir 188. Of course, the loop is continuous and so the other side 186*b* is eventually pulled from the reservoir 188 until the whole ribbon 186 has been appropriately wound into the cassette 184. String loop 198 is utilized to pull the spring 194 downward to allow insertion of the pancake into the reservoir 188**.

Motor 62 can be selected such that it is capable of driving both forward and reverse. This would allow reversal of the direction of rotation of drives 94, 100 and 106 from that described. This allows for expansion of the capabilities of the machine 20 to handle cassettes which differ from standard ones now marketed.

I claim:

1. An improvement in a ribbon machine of the type capable of feeding a ribbon into a ribbon cassette, the cassette being of the type having a ribbon discharge opening and a ribbon feed opening, which comprises:

a support surface;

ribbon guide means associated with said support surface for guiding said ribbon over said support surface from the ribbon discharge opening to the ribbon feed opening of said cassette;

at least two cassette adapters, each adapter including cassette holding means capable of reversibly holding on said adapter at least one type of a variety of types of cassettes, and each of said cassette adapters (holders) capable of holding a different type of cassette;

a plurality of adapter positions located on said support surface, each of said adapter positions including cassette drive means and cassette adapter holding means, each of said cassette adapters capable of being held by the respective cassette adapter holding means at one of said plurality of adapter positions;

each of said cassette adapters including cassette driven means transfer means capable of allowing said cassette drive means to interact with said cassette to feed said ribbon into said cassette.

2. The ribbon machine of claim 1 wherein:

each of said cassette adapters includes an adapter plate having a top face and a bottom face, said cassette holding means capable of reversibly holding said cassette on said top face.

3. The ribbon machine of claim 2 including:

adapter plate orientation and retaining means located on the bottom face of said adapter plate and capable of interacting with one of said cassette adapter holding means to orient and reversibly retain said adapter plate on said support surface at one of said adapter positions.

4. The ribbon machine of claim 3 wherein:

each of said cassette drive means includes a drive shaft rotatably mounted on said support surface and a drive shaft rotation means operatively connected to said drive shafts to rotate said drive shafts;

a portion of each of said drive shafts projecting above said support surface.

5. The ribbon machine of claim 4 wherein:

each of said cassette adapter holding means includes said support surface at each of said adapter positions having a surface locking fixture and at least one surface aligning fixture associated with said surface locking fixture and both said surface aligning fixture and said surface locking fixture associated with said portion of said drive shaft projecting above said surface at each of said adapter positions;

said adapter plate orientation and retaining means having at least one plate aligning fixture sized and shaped to interact with said surface aligning fixture of one of said adapter positions, and a plate locking fixture sized and shaped to reversibly lock with said surface locking fixture when said adapter plate and surface aligning fixtures interact with each other.

6. The ribbon machine of claim 5 wherein:

said cassette drive means transfer means comprises each of said adapter plates including a hole passing from said bottom face to said top face and positioned on said adapter plate to allow said drive shaft to be positioned in said hole and rotate in said hole when said adapter plate is in one of said adapter positions and said surface locking fixture and said plate locking fixture are locked together.

7. The ribbon machine of claim 6 wherein:

each of said surface aligning fixtures includes at least one aligning hole in said support surface and said plate aligning fixtures include at least one aligning member sized and shaped to fit into said aligning hole at one of said adapter positions;

said surface locking fixture includes said surface having at least one locking hole at each of said adapter positions and said plate locking fixtures comprise a locking member sized and shaped to fit into and reversibly lock in said locking hole at said adapter position.

8. The ribbon machine of claim 7 wherein:

said plurality of adapter positions comprises three adapter positions on said support surface, each of said adapter positions having at least one aligning hole, a locking hole and a drive shaft;

said cassette drive means includes a variable speed motor, linking means between said motor and all of said three drive shafts, and control means operatively associated with said motor to control the speed of said motor.

9. The ribbon machine of claim 8 wherein:

for one of said positions said drive shaft is to the left of said locking hole and rotates in a counterclockwise direction, for a second of said positions said drive shaft is to the right of said locking hole and rotates in a counterclockwise direction, and for the third of said positions said drive shaft is to the left of said locking hole and rotates in a clockwise direction.

10. The ribbon machine of claim 9 wherein:

said ribbon guide means includes a ribbon inking means, a ribbon heating means, a drive capstan, and a ribbon sensing means;

said ribbon feeding out of said discharge opening in said cassette, passing over said ribbon heating means, by said ribbon sensing means, over said ribbon inking means and over said drive capstan prior to returning into said cassette.

11. The ribbon machine of claim 10 wherein:

said cassettes are of the type having an internal rewind pinch wheel which contacts said ribbon to feed said ribbon into the interior of said cassette and an exposed socket operatively associated with said internal rewind pinch wheel to rotate said rewind pinch wheel in response to rotation of said socket;

said drive shaft operatively mating with and rotating said socket when said cassette is attached to said adapter plate which is in turn locked to said support surface by said locking member of said adapter plate interacting with said locking hole at said adapter position wherein said cassette is located and said drive shaft at said adapter position wherein said cassette is located is rotated by said linking means.

12. The ribbon machine of claim 10 wherein:

said cassette is of the type which does not have an internal rewind wheel and including said cassette drive means transfer means having an external wheel rotatably attached on the top face of said adapter plate and positioned on said adapter plate to interact with said ribbon to feed said ribbon into said cassette, said drive shaft at said adapter position wherein said cassette is located operatively connecting to said external wheel to rotate said wheel.

13. The ribbon machine of claim 8 including:

each of said adapter plates having at least one positioning pin on said top face, said positioning pin capable of interacting with a cassette of one of said types of said cassettes to prevent said cassette from moving in a plane parallel with the plane of the top face.

14. The ribbon machine of claim 1 including:

a ribbon feed reservoir means capable of being associated with said support surface;

said reservoir means including a ribbon reservoir capable of holding a quantity of a ribbon formed as a continuous loop;

said reservoir means including an opening allowing ribbon ingress and egress to said reservoir means and loop dividing means located in said opening and projecting into the interior of said reservoir means and capable of contacting one of the sides of said opening such that when said continuous loop of said ribbon is located in said reservoir means and when a segment of said loop is withdrawn from said reservoir said loop dividing means will contact said segment and bias said segment against said side of said opening to temporarily retain one side of said segment of said loop within the interior of said reservoir means while allowing the other side of said loop to be withdrawn from said reservoir means such that the other side of said loop can be fed into said ribbon cassette until all of said ribbon has been withdrawn from said reservoir means.

15. The ribbon machine of claim 14 wherein:

said loop dividing means comprises an arcuate shaped spring member.

16. An improvement in a ribbon machine of the type used to re-ink ribbons housed in ribbon cassettes, the cassettes being of the type having a ribbon discharge opening and a ribbon feed opening, which comprises:

a support surface;

ribbon guide means associated with said support surface for guiding said ribbons over said support surface from the ribbon discharge opening to the ribbon feed opening of said cassettes;

at least two cassette adapters, each adapter including cassette holding means capable of reversibly holding on said adapter at least one type of a variety of types of cassettes, and each of said cassette adapters capable of holding a different type of cassette;

a plurality of adapter positions located on said support surface, each of said adapter positions including cassette drive means and cassette adapter holding means, each of said cassette adapters capable of being held by the respective cassette adapter holding means at one of said plurality of said adapter positions;

each of said cassette adapters including cassette drive means transfer means capable of allowing said cassette drive means to interact with said cassette to feed said ribbon into said cassette;

said ribbon guide means including a ribbon inking means, a ribbon drive means and at least one ribbon heating means, said ribbons being fed by said drive means first over said heating means to iron said ribbons and then over said inking means to add ink to said ironed ribbons.

* * * * *